US009943974B2

(12) United States Patent
Matsunaga

(10) Patent No.: US 9,943,974 B2
(45) Date of Patent: Apr. 17, 2018

(54) THREADING FOR SLITTER

(71) Applicant: Braner USA, Inc., Schiller Park, IL (US)

(72) Inventor: Douglas S. Matsunaga, Mettawa, IL (US)

(73) Assignee: Braner USA, Inc., Schiller Park, IL (US)

( * ) Notice: Subject to any disclaimer, the term of this patent is extended or adjusted under 35 U.S.C. 154(b) by 117 days.

(21) Appl. No.: 14/716,228

(22) Filed: May 19, 2015

(65) Prior Publication Data

US 2016/0339593 A1 Nov. 24, 2016

(51) Int. Cl.
*B26D 1/24* (2006.01)

(52) U.S. Cl.
CPC ..... *B26D 1/245* (2013.01)

(58) Field of Classification Search
CPC . B26D 1/245; B26D 1/24; B26D 5/06; B26D 7/2635; Y10T 83/141; Y10T 83/162; Y10T 83/7826; Y10T 83/7855; Y10T 83/0222; Y10T 83/4798; Y10T 83/9401; Y10T 225/15; Y10T 428/12188; Y10T 83/0215; Y10T 83/023; Y10T 83/0311; Y10T 83/0304; Y10T 83/0378; Y10T 3/0348; Y10T 83/0467; Y10T 83/0548; B21B 2015/0021; B21B 1/0815; B21D 13/00; B21D 13/045; B21D 13/04; B21D 31/043; B26F 1/10; B26F 1/08; B23D 19/06; B23D 35/00
See application file for complete search history.

(56) References Cited

U.S. PATENT DOCUMENTS 3,730,043 A * 5/1973 Zimmermann ..... B23D 19/06 241/236
4,155,238 A * 5/1979 Rogers ..... B21C 47/006 29/413
5,000,812 A * 3/1991 Murphy ..... B26D 1/626 156/268
8,191,451 B2 * 6/2012 Stolyar ..... B26D 7/2635 83/499
8,267,847 B2 * 9/2012 Cummings ..... B26D 5/00 493/22

(Continued)

FOREIGN PATENT DOCUMENTS

EP 1997596 A1 * 12/2008 ..... B26D 7/2635

*Primary Examiner* — Jonathan Riley
(74) *Attorney, Agent, or Firm* — Botkin & Hall, LLP

(57) ABSTRACT

A method for slitting sheet material having a thickness, a width, a leading edge and a shear strength. The slitter has rotatable arbors and knives on each arbor that rotate about their axes and are held adjacent to each other. A computer is used to calculate a first and second spacing for the arbors based on the shear strength, outer diameter, and thickness of the material. The material is inserted between the knives and the leading edge passes through the slitter with the arbors the first position that pinches the material between outer diameters of opposing knives as it moves forward. While the material moves forward the arbors are moved into a second and closer position in which the knives are situated to slit the material as it passes between the knives. This slitting of material behind the leading edge creates a leading tab holding the slit strips together.

5 Claims, 5 Drawing Sheets

(56) References Cited

U.S. PATENT DOCUMENTS

2008/0295664 A1* 12/2008 Stolyar ..... B26D 7/2635
83/506
2013/0202765 A1* 8/2013 Nagayama ..... B26D 1/255
426/557

* cited by examiner

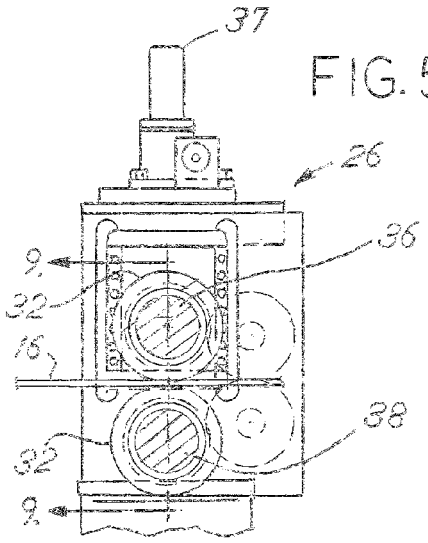
FIG. 5
FIG. 6
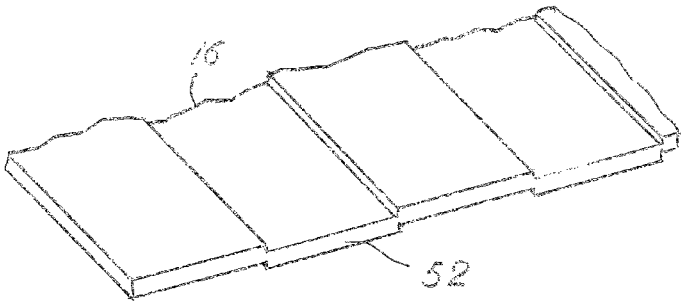
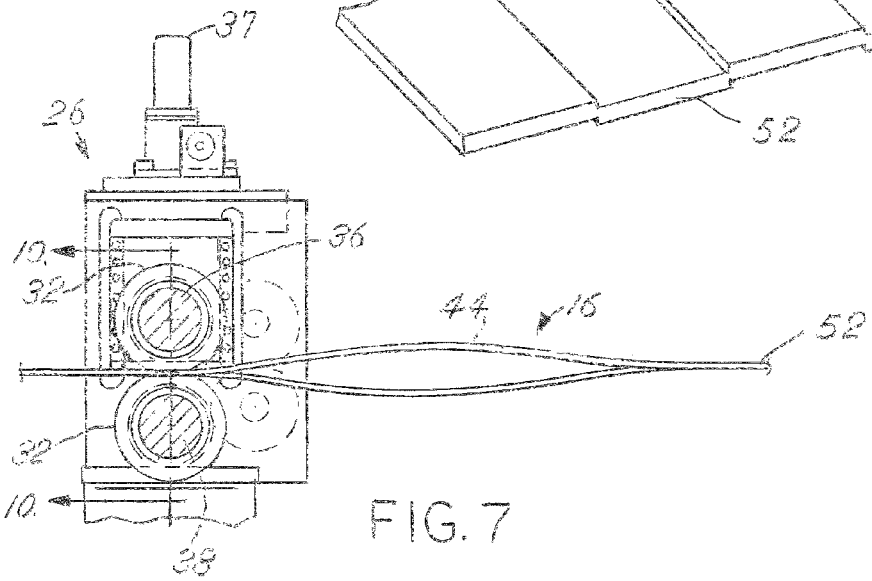
FIG. 7

THREADING FOR SLITTER

BACKGROUND OF THE INVENTION

Producing multiple slit coils of metal from a single coil of metal is a useful process that transforms a large coil of steel into more useable pieces of a desired width. One of the most difficult parts of the process is getting started. When starting a slitter, the traditional method of doing so required slowly feeding the material into the slitter during the startup with the slitter knives slitting the material from the moment the leading edge of the coil contacted the slitter knives. Immediately after the slit material leaves the slitter the leading edge is transformed into multiple strips of metal. The then slit material curls in opposite directions and the ends spread apart in alternating up and down directions. Depending on the thickness of the material positioning the slit material is a challenge for different reasons. In the case of extremely thin material, the thin edges may act as blades that may cut operators who are forced to handle multiple freely moving strips of steel. In the case of thick material, blunt force is required to wrestle the material into position to be fed into subsequent parts of the slitting line. The operators of the slitter are forced to handle multiple relatively narrow strips of metal from the slitter across the pit table above a looping pit. Operators are forced to move the coil forward at a very slow rate of speed while carefully threading each of the many strips into a tensioner. The strips must be further wrestled into position to be placed into a recoiler. To avoid having multiple slit strips flopping in multiple directions operators have had to employ their own makeshift solutions to keep the strips together. One of these has been for the operators to clamp the multiple strips between boards, then take the heavy, awkward board and metal clamped leading edge through the slitter line until the leading edge of the metal can be attached to the recoiler. This additional step of attaching a makeshift jig made from clamped boards slows the threading process down from its normal running speed compared. An easier way to keep the slit strips together through the threading process is needed.

SUMMARY OF THE INVENTION

The present invention is a method for slitting sheet material. The material itself has a thickness, a width, a leading edge and a shear strength. The slitter has rotatable arbors that rotate about their axes and are held adjacent to each other. Each arbor has a knife affixed thereto and the knives are adapted for slitting material passing between them. The knives have an outer diameter. A computer is used to calculate a first and second spacing for the arbors based on the shear strength, outer diameter, and thickness of the material. The material is inserted between the knives and the leading edge passes through the slitter with the arbors in the first position that pinches the material as it moves forward. While the material moves forward the arbors are moved into a second and closer position in which the knives are situated to slit the material as it passes between the knives. This slitting of material behind the leading edge creates a leading tab that is defined by the leading edge and extends rearward to a location where the material has been slit by the knives.

A computer may be used to control the positions of the arbors that plunge knives into the sheet of material passing between the knives.

BRIEF DESCRIPTION OF THE DRAWINGS

FIG. 5 is a sectional view of the slitter shown in FIG. 4 with metal passing through it;

FIG. 6 is a view of the metal passing through the slitter that has been pinched but not cut by the slitter;

FIG. 7 is a sectional view of metal passing through the slitter having been slit after the arbors are moved into their second position;

DETAILED DESCRIPTION OF INVENTION

Figure 1:
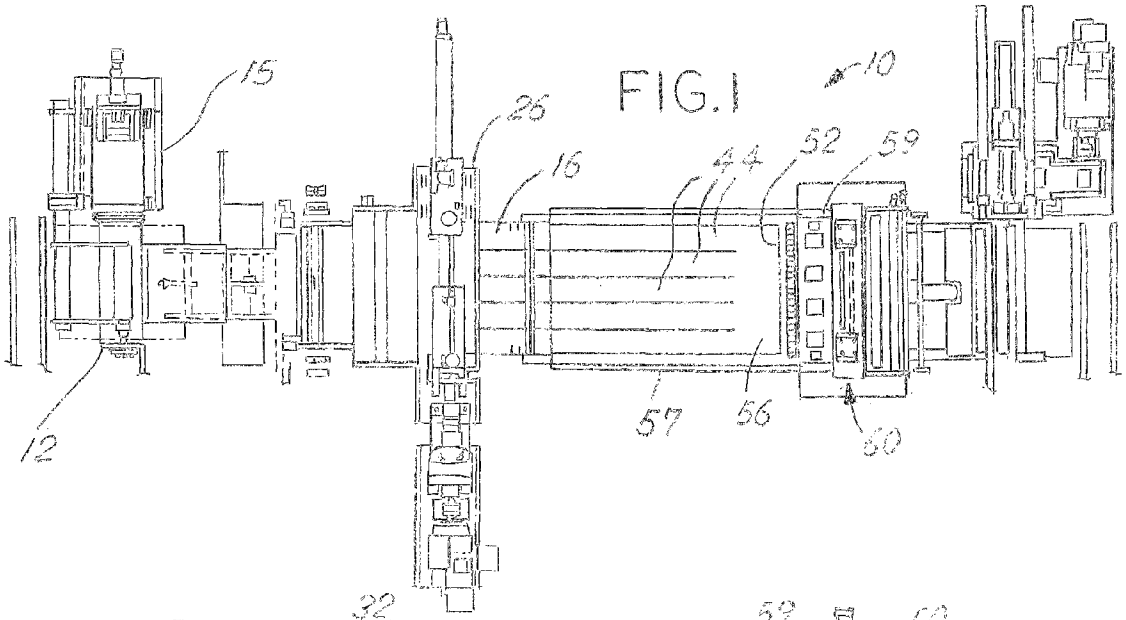
FIG. 1 is an overview from above of the slitter according to the present invention with the metal being slit shown in partial phantom for clarity.
Figure 3:
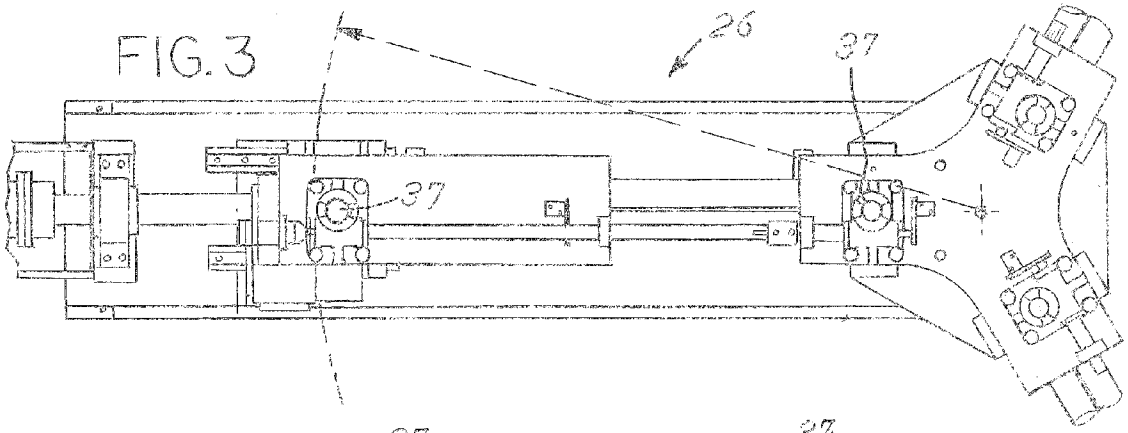
FIG. 3 is a top view of the slitter shown in FIGS. 1 and 2.
Figure 4:
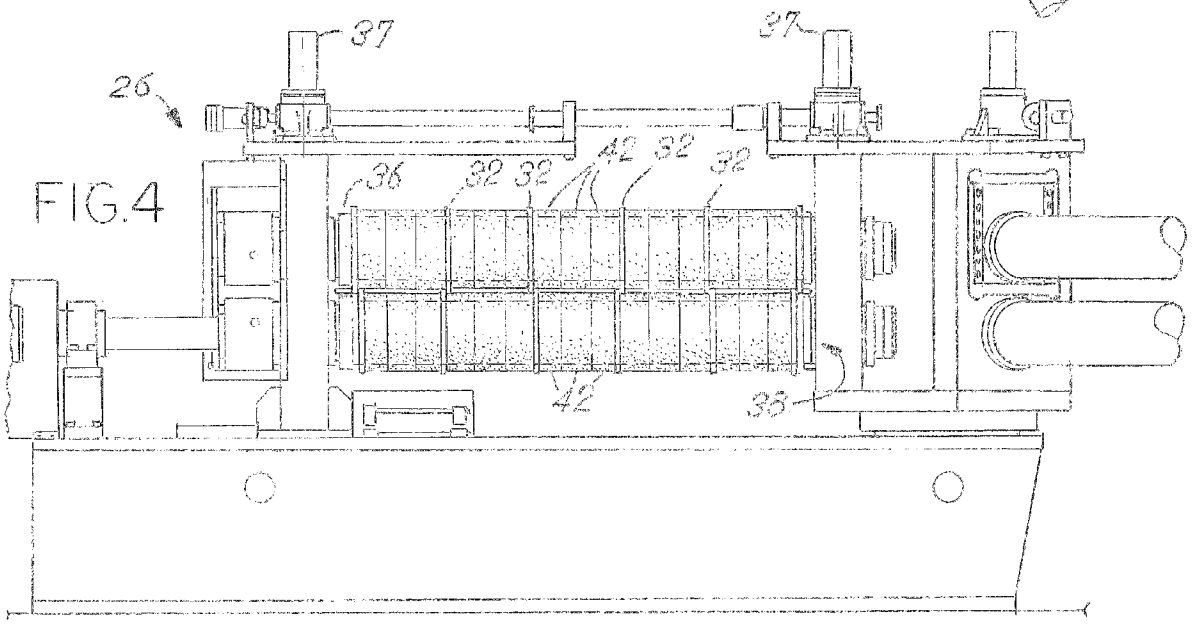
FIG. 4 is a front view of the slitter shown in FIG. 3.
Figure 8:
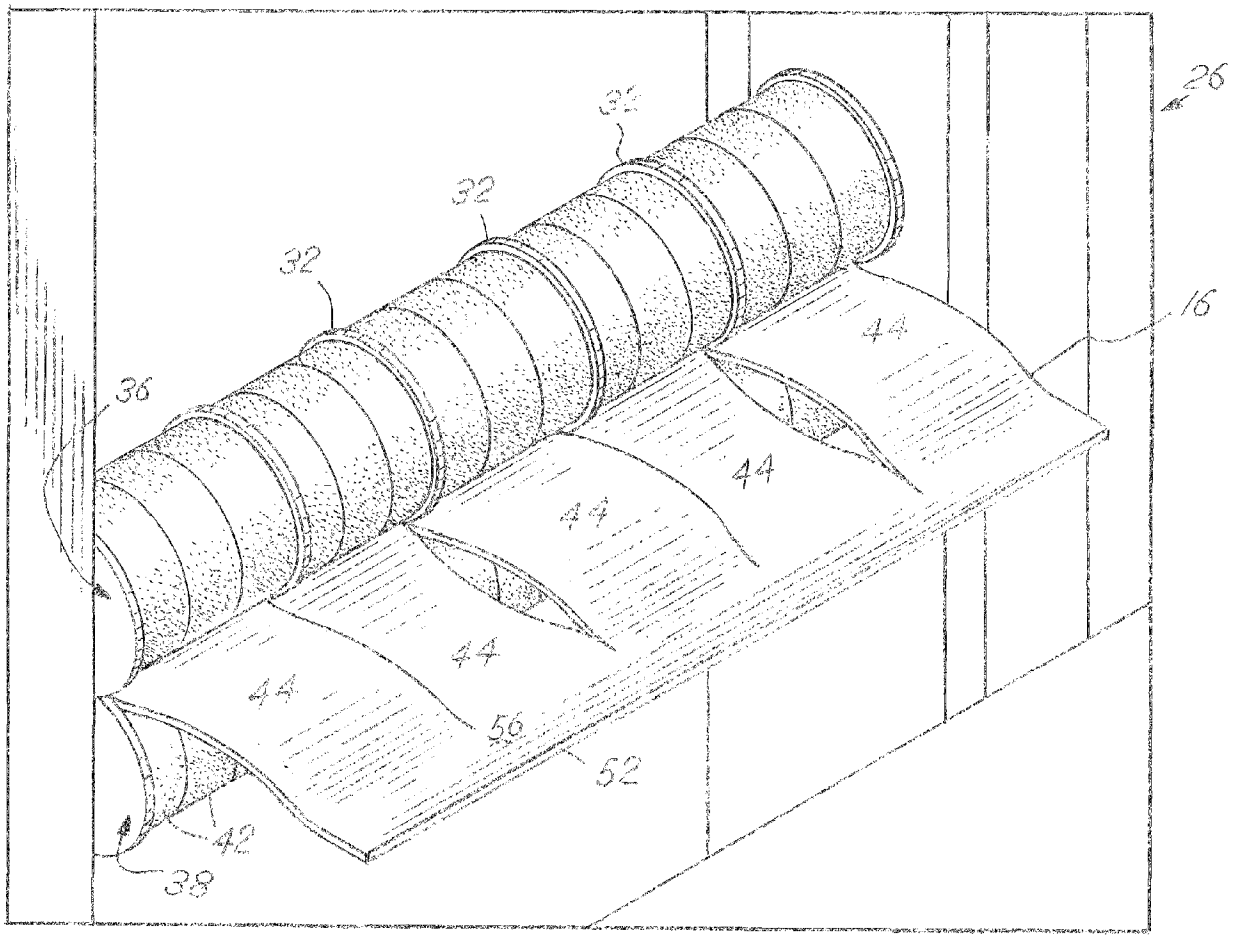
FIG. 8 is a perspective view similar to that of FIG. 7 showing the metal slit behind its leading tab.

FIG. 1 shows an overview of the slitter line 10 invention from above. The beginning of the slitter line 10 includes an uncoiler 12 that holds a coil 14 of metal 16. The metal 16 is unwound from the coil 14 on an uncoiler 15 and fed onto a peeler table 18 that is adjacent to the coil 14 and supports the metal as it leaves the coil 14. From the peeler table 18, the metal 16 is fed into the slitter 26. In the case of the present invention, the slitter 26 is a driven slitter in which arbors 34 are driven. The slitter 26 has a series of knives 32 that are spaced on the opposing arbors 34. FIG. 3 shows the details of a turret head slitter 26. The upper arbor 36 and lower arbor 38 may be adjusted so the space between them is variable. This is typically done by having the lower arbor 38 remain in a fixed position and having the upper arbor 36 move relative to the lower arbor 38 so that the distance between the arbors 36, 38 is changed. Changing the spacing between the arbors is accomplished with the use of screw actuators 37. Knives 32 are spaced along the arbors and their spacing is maintained by spacers 42 that set precise distances between the knives 32. The knives are fixed to the arbors 36, 38 so that when the arbors 36, 38 are driven, the knives 32 rotate with the arbors 36, 38. The knives 32 are ground on their diameters and generally, the knives 32 are ground to the same diameter. Thus, it is possible to know the vertical distance between the knives 32 based on the distance between the centers of the arbors 38. The vertical distance between the arbors 36, 38 and the corresponding distance between the knives 32 is changed depending on the material run through the slitter 26. The distance between the arbors 36, 38 is chosen based on the thickness of material to be slit, as well as the hardness of the material to be slit. A vertical gap can exist between outer diametrical surfaces 50 of the knives and the arbors 36, 38 can be moved so the outer diametrical surfaces 50 overlap. FIG. 4 shows the case where the outer diametrical surfaces 50 of the knives overlap.

Choosing the spacing between arbors 36, 38 and therefore, the spacing between the knives 32 is important. When slitting material, it is not necessary to have overlapping knives 32 as shown in FIG. 4, in other words some material may be slit with a gap between the knives 32. Having such an overlapping condition can be detrimental to slitting performance in some cases. Improper vertical clearance may lead to deflection in the arbors 36, 38, chipped knives 32, and potentially dimensional inconsistencies in the slit material. The slitter line 10 includes a computer that calculates the proper knife 32 vertical spacing needed to effectively slit the metal 16 that will be fed through it based on information entered by an operator. The outer diameter of the knives 32 must be entered because the computer will be able to maintain information on the location of the arbors 36, 38 and the distance of the outer diametrical surfaces 50 from the arbors 36, 38 is dependent on the diameter of the knives. Generally, knives will be ground in sets to the same diameter. Another piece of information will be the thickness of the material to be slit. The knives 32 will be set to an appropriate vertical distance to slit the material. Also, the shear strength of the material will be input. Based on the inputs the computer will calculate two positions for the arbors 36, 38 and consequently the knives 32 fixed thereon.

In prior art slitters, the metal 16 is fed from left to right which corresponds to a forward direction through the slitter line. The knives of a prior art slitter are set to a spacing locating the outer diameters of the opposing knives so that the material is slit before the material is fed into the slitter. In the case of prior art slitters, the leading edge 52 of the material is slit by the knives 32 as is all material behind the leading edge 52. This meant that the metal 16 upon being slit became multiple independent strips 44 which could move in different directions. The problem created by this situation is that threading multiple slit strips 44 of the metal through portions of the slitter line 10 subsequent to the slitter 26 was extremely difficult and potentially dangerous.

Figure 9:
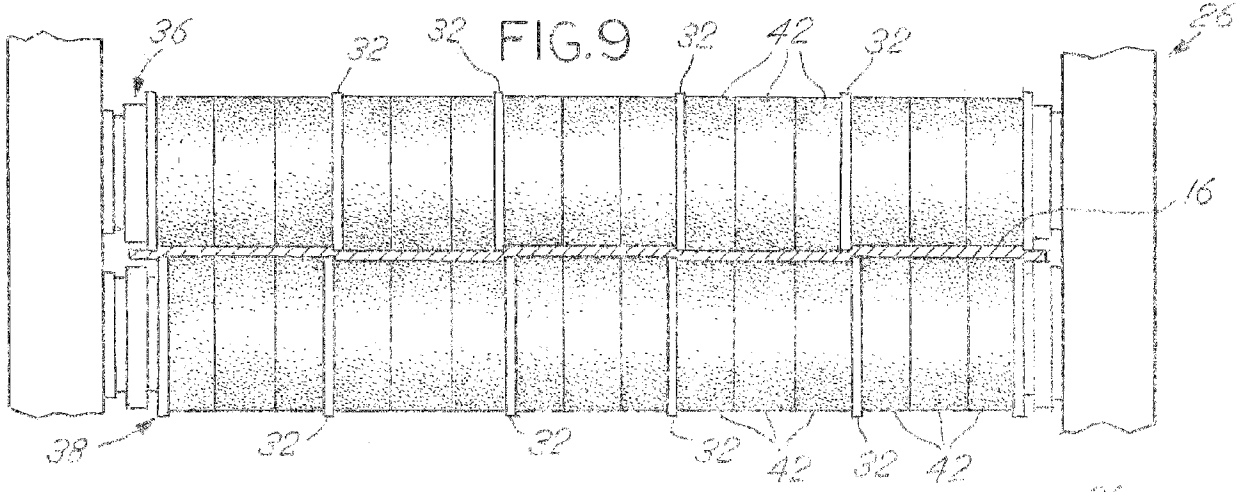
FIG. 9 is a front view of the slitter taken about line 9-9 in FIG. 5 with the arbors in their first position.
Figure 10:
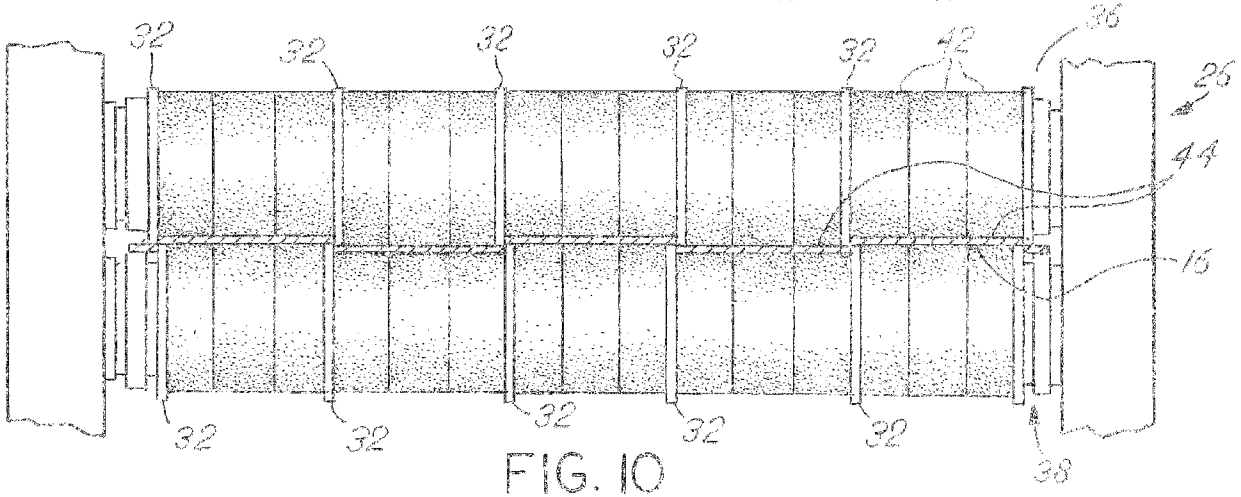
FIG. 10 is a front view of the slitter taken about line 10-10 in FIG. 7 with the arbors in their second position.

The slitter line 10 of the present invention, does not begin slitting at the leading edge 52. The computer chooses a first position of the arbors 36, 38 that locates the knives 32 in a position to pinch the metal 16 that travels between the opposing knives 32. This simultaneous contact by opposing knives 32 on both sides of the metal 16 is shown in FIG. 9. This effect on the metal 16 is shown in FIG. 6. The first position of the arbors 36, 38 is shown in FIG. 9. The metal is deformed somewhat, but not slit. This allows the outer diametrical surfaces 50 of opposing knives to have a grip on the metal 16 as the driven knives 32 on the arbors 36, 38 drive the material forward through the slitter 26, which corresponds to moving from left to right in FIGS. 1 and 2. The grip on the metal 16 affirmatively and safely guides the metal forward and leaves the metal 16 continuous along its width adjacent to the leading edge 52. As the metal moves forward through the slitter 26, the computer actuates the screw actuators 37, which moves the arbors 36, 38 closer together to a second position that is shown in FIG. 10. In this second position, the arbors 36, 38 are closer together and the knives are closer as well. This second position is achieved by moving the upper arbor 36 downward to the lower arbor 38. In the second position, the knives 32 are configured to be at a vertical spacing necessary to slit the material. The transition from the first position to the second position of the knives 32 and arbors 36, 38 is done gradually as the material moves forward. If the arbors 36, 38 were moved together closer with the metal 16 not moving, immense forces would be required to plunge the knives 32 into the metal 16 to bring the arbors 36, 38 closer together. Such forces would most likely exceed the capacity of the screw actuators 37, could excessively deflect the arbors, and also could damage the knives 32.

Figure 2:
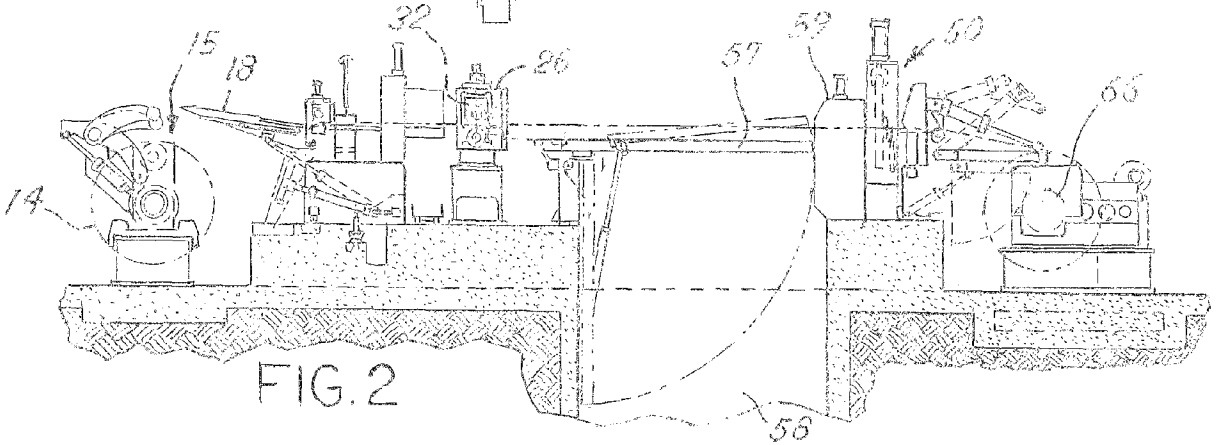
FIG. 2 is a side view of the slitter line shown in FIG. 1 with the metal being slit shown in partial phantom for clarity.

Once the knives 32 and arbors 36, 38 are in their second position, which slits the metal 16, a leading tab 56 will be formed. The leading tab 56 is the continuous strip 44 of metal extending behind the leading edge 52 until the metal 16 is slit. This leading tab 56 keeps the individual strips 44 together and the leading tab 56 is continuous across the width of the metal 16. The slitter 26 holds the arbors 36, 38 in the second position and the metal 16 is moved forward for a predetermined distance and then paused. This allows for inspection of the leading tab 56 and the slit strips 44. Upon a satisfactory inspection, the metal 16 is moved forward. Typically after the slitter, 26 the metal 16 will move across a pit table 57 over a looping pit 58. The leading tab 56 is moved through a tensioner 59 that is forward of the looping pit 58. The metal and its leading tab 56 is advanced until the leading tab 56 is beyond a shear 60. The shear 60 is then used to cut the leading tab 56 from the metal 16 and the strips 44 are then unconnected at their respective ends. As can be seen in FIGS. 1 and 2, the metal 16 is very near the recoiler 66 at this point and it is a simple operation to connect the strips 44 to the recoiler 66 to wind the slit strips 44 onto the recoiler. 66.

The invention is not limited to the details given above, but may be modified within the scope of the following claims.

What is claimed is:

1. A method for slitting sheet material comprising the steps of:

providing a sheet of material having a thickness, a width, a leading edge, and a shear strength;

providing a slitter having arbors rotatable about their axes and being held adjacent and spaced from each other, each said arbor containing a knife fixed thereon being adapted for slitting said material, said knives having an outer diameter;

inputting said thickness and shear strength and said outer diameter of said knives into a computer;

said computer calculating a first position that locates said outer diameters of said knives to simultaneously contact opposing surfaces of said material passing between said knives and said arbors said first position locating said knives so that said material passing between said knives is not slit;

said computer calculating a second position for said arbors which sets a second spacing between said knives and said arbors, said second position of said arbors locating said knives so that material passing between said knives is slit;

inserting said material between said knives and moving said material forward through said slitter with said knives in said first position for a predetermined distance thereby pinching said material between said knives and leaving said material pinched in an unslit condition to define a leading tab;

continuing to move said material through said slitter and moving said arbors into said second position while moving said material forward through said slitter, said second position of said arbors corresponding to said arbors being nearer each other than in said first position and said material moved through said slitter with said arbors in said second position being in a slit condition wherein said material includes a leading tab defined by said leading edge and extending rearward to a location where said material has been slit by said knives in said second position, maintaining said knives in said second position so that said all of said material rearward of said leading tab is slit.

2. The method of claim 1, wherein said computer is connected to an actuator for moving said arbors into said first and second positions.

3. The method of claim 2, wherein said actuator moving said arbors is a screw type actuator.

4. The method of claim 1, wherein said leading tab moved to a desired location beyond said slitter, cutting said leading tab from said material when said leading tab is in said desired location.

5. The method of claim 1, wherein said desired location is a recoiler.

* * * * *